US006186749B1

(12) United States Patent
Bouille et al.

(10) Patent No.: US 6,186,749 B1
(45) Date of Patent: Feb. 13, 2001

(54) MOLECULAR DRAG PUMP

(75) Inventors: André Bouille; Jean-Francois Guilbert, both of Annecy (FR)

(73) Assignee: Alcatel, Paris (FR)

( * ) Notice: Under 35 U.S.C. 154(b), the term of this patent shall be extended for 0 days.

(21) Appl. No.: 09/266,729

(22) Filed: Mar. 12, 1999

(30) Foreign Application Priority Data

Mar. 16, 1998 (FR) ..... 98-02-191

(51) Int. Cl.[7] ..... F04B 35/04
(52) U.S. Cl. ..... 417/295; 417/423.4
(58) Field of Search ..... 417/295, 423.4; 451/118

(56) References Cited

FOREIGN PATENT DOCUMENTS 0 332 107 A1 9/1989 (EP) .
0 397 051 A1 11/1990 (EP) .

*Primary Examiner*—Charles G. Freay
(74) *Attorney, Agent, or Firm*—Sughrue, Mion, Zinn, Macpeak & Seas, PLLC

(57) ABSTRACT

A molecular drag pump comprising a rotor housed inside a case having a suction inlet and a delivery outlet, said pump being associated at its inlet with a valve comprising a valve mechanism inside a valve envelope, wherein the valve envelope is integral with said pump case.

6 Claims, 2 Drawing Sheets

MOLECULAR DRAG PUMP

The present invention relates to a molecular drag pump.

The term "molecular drag pump" is used to cover any secondary vacuum pump of mechanical type having a spinning rotor, regardless of whether it uses fins or a drum or a combination thereof.

BACKGROUND OF THE INVENTION

In industrial methods where an enclosure needs to be evacuated, the pump unit includes, in particular, a molecular drag pump connected to the enclosure to be evacuated via a valve.

OBJECT AND SUMMARY OF THE INVENTION

An object of the present invention is to reduce the size of such an assembly, and to reduce the number of sealing gaskets.

The invention thus provides a molecular drag pump comprising a rotor housed inside a case having a suction inlet and a delivery outlet, said pump being associated at its inlet with a valve comprising a valve mechanism inside a valve envelope, wherein the valve envelope is integral with said pump case.

BRIEF DESCRIPTION OF THE DRAWINGS

A particular embodiment of the invention is described below with reference to the accompanying drawings, in which.

MORE DETAILED DESCRIPTION

Figure 1:
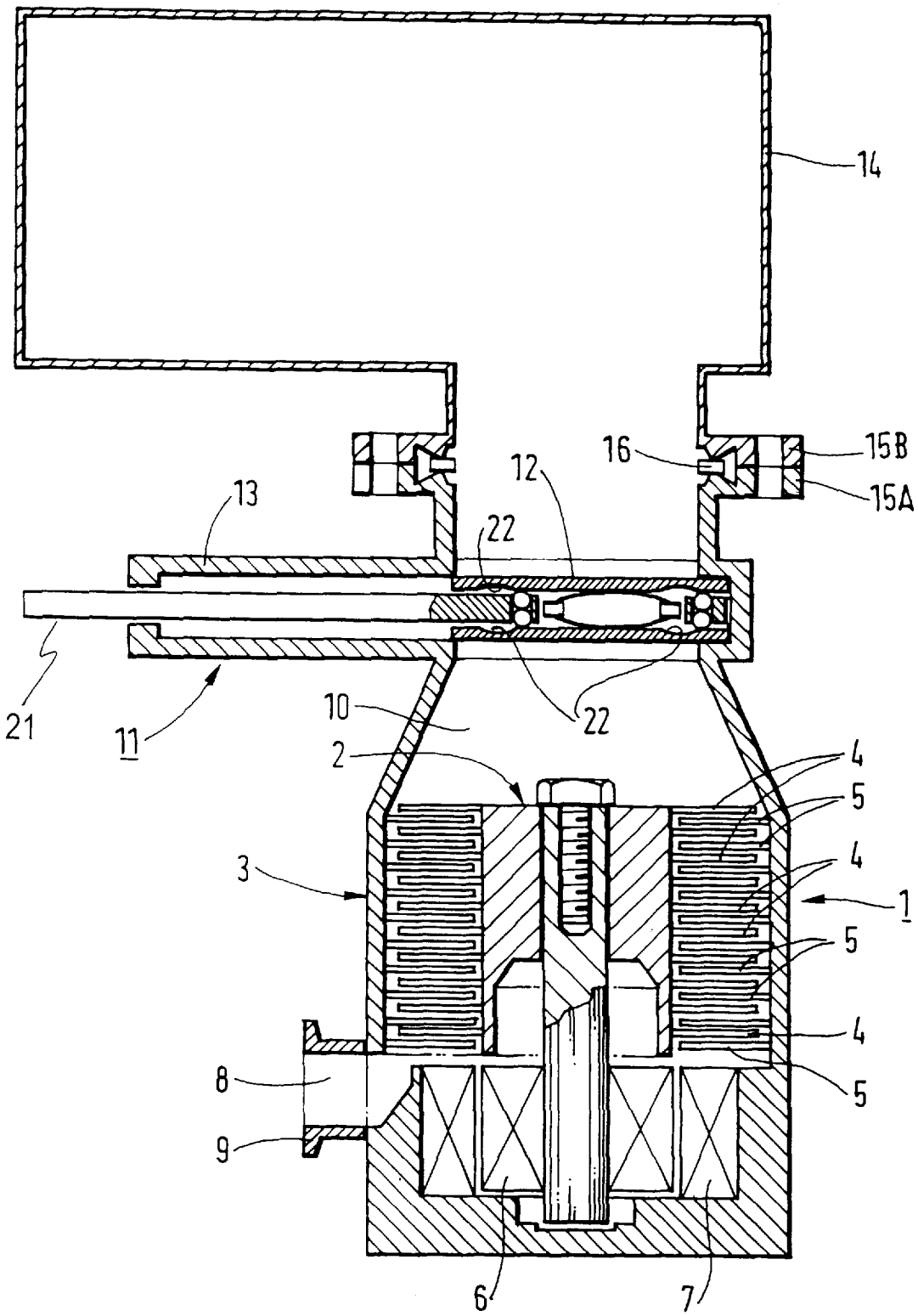
FIG. 1 shows a molecular drag pump of the invention connected to an enclosure to be evacuated.

With reference to the figures, there can be seen a molecular drag pump 1 comprising a rotor 2 housed inside a case 3.

The rotor 2 comprises a plurality of stages 4 of moving fins, and the case 3 carries a plurality of stages of stator fins 5.

6 designates the rotor of an electric drive motor, and 7 the stator of said motor.

The case 3 of the pump has a delivery outlet 8 with a connection flange 9 to enable it to be assembled to a primary pump.

At its suction inlet 10, the pump 1 is associated with a valve 11 including a valve mechanism 12 situated inside an envelope 13.

In accordance with the invention, the envelope 13 of the valve 11 is integral with the case 3 of the pump 1. The envelope 13 and the case 3 thus constitute a single piece without any assembly.

The pump is connected to an enclosure to be evacuated 14 by means of assembly flanges 15A–15B and a sealing gasket 16 between the two flanges 15A and 15B.

Thus, the disposition of the invention makes it possible to avoid using a flange assembly between the pump 1 and the valve 11, thereby considerably reducing its size and eliminating a sealing gasket between the pump and the valve. Eliminating a gasket is advantageous since that reduces pollution in the enclosure 14.

When condensable gases are being pumped, they condense, and specifically they condense on the gaskets since the gaskets are difficult to heat.

The compactness that results from eliminating a level of assembly also makes it possible to increase conductance slightly.

Figure 2:
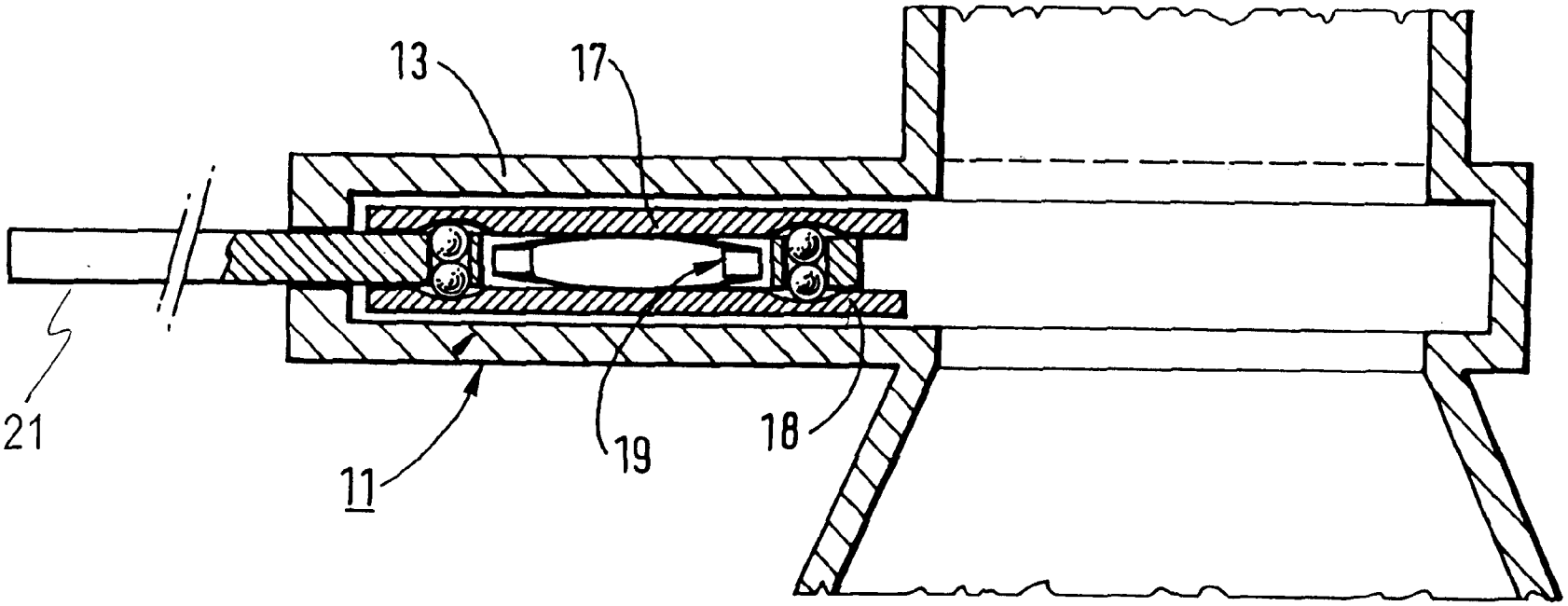
FIG. 2 is an enlarged view of the valve.

The valve shown is a slide valve whose mechanism comprises two moving valve members 17 and 18 urged towards each other by a return spring 19. Between the two valve members, there is a carriage 20 associated with a control shaft 21. The carriage has balls 23 which, when the valve is in its open position (FIG. 2), are received in part in grooves 22 formed in the valve members, thereby enabling the valve members to move towards each other under drive from the return springs 19.

In FIG. 1 the valve is shown in its closed position, the valve members are in abutment against the end of the envelope 13, thus making it possible by applying thrust to the shaft 21, to expel the balls from the grooves 22 and thus move the valve members 17 and 18 apart.

This slide valve is a valve that operates in on/off mode.

Nevertheless, the invention is applicable to any kind of valve, in particular to a flow rate regulator valve, given that the invention lies in the fact that the valve envelope and the pump case constitute a single piece without any assembly between them.

What is claimed is:

1. A molecular drag pump comprising a rotor housed inside a case having a suction inlet and a delivery outlet, said pump being associated at its inlet with a valve comprising a valve mechanism inside a valve envelope, wherein the valve envelope is an integral one piece construction with said pump case.

2. A molecular drag pump comprising:

a pump case having a suction inlet, a delivery outlet, and a valve envelope; and a rotor housed inside said pump case;

wherein said valve envelope is part of a same casting as said pump case so that said valve envelope and said pump case form an integral one piece construction.

3. The molecular drag pump according to claim 2, wherein said valve envelope is on a suction side of said pump.

4. The molecular drag pump according to claim 3, further comprising a slide valve disposed in said valve envelope.

5. A molecular drag pump comprising:

a pump case having a suction inlet, a delivery outlet, and a valve envelope; and a rotor housed inside said pump case;

wherein said valve envelope and said pump case form a one piece homogeneous structure.

6. The molecular drag pump according to claim 5, wherein said valve envelope is on a suction side of said pump.

* * * * *